US010086490B2

(12) United States Patent
Kobayashi

(10) Patent No.: US 10,086,490 B2
(45) Date of Patent: Oct. 2, 2018

(54) SURFACE TREATMENT METHOD FOR METAL PARTS

(71) Applicant: TIPTON CORP., Nagoya-shi, Aichi (JP)

(72) Inventor: Tomoyuki Kobayashi, Nagoya (JP)

(73) Assignee: TIPTON CORP., Nagoya-Shi, Aichi (JP)

( * ) Notice: Subject to any disclaimer, the term of this patent is extended or adjusted under 35 U.S.C. 154(b) by 82 days.

(21) Appl. No.: 15/402,615

(22) Filed: Jan. 10, 2017

(65) Prior Publication Data

US 2017/0259393 A1 Sep. 14, 2017

(30) Foreign Application Priority Data

Mar. 11, 2016 (JP) ..... 2016-048105

(51) Int. Cl.
*B24B 31/02* (2006.01)
*B24B 57/02* (2006.01)
*B24B 1/04* (2006.01)

(52) U.S. Cl.
CPC ..... *B24B 31/02* (2013.01); *B24B 1/04* (2013.01); *B24B 57/02* (2013.01)

(58) Field of Classification Search
CPC ..... B24B 31/02; B24B 57/02; B24B 1/04
See application file for complete search history.

(56) References Cited

U.S. PATENT DOCUMENTS 1,945,035 A * 1/1934 Green ..... B24B 31/02 366/232
2,224,545 A * 12/1940 Lach ..... B24B 31/02 15/90
2,318,580 A * 5/1943 Balz ..... B24B 31/14 451/330
2,318,581 A * 5/1943 Balz ..... B24B 31/14 451/330
2,359,323 A * 10/1944 Lupo ..... B24B 31/02 451/34

(Continued)

FOREIGN PATENT DOCUMENTS

GB 1007553 A 10/1965
JP H01-194947 A 8/1989

(Continued)

OTHER PUBLICATIONS

Philippines Search Report dated Apr. 12, 2017 in Philippines Application No. 1-2017-000001 (7 pages).

*Primary Examiner* — George Nguyen
(74) *Attorney, Agent, or Firm* — Smith, Gambrell & Russell, LLP

(57) ABSTRACT

A surface treatment method for metal parts includes a polishing step of supplying and discharging a cleaning liquid into and from a barrel tub while mass including a metal part and a medium is caused to flow in the barrel tub, so that a surface of the metal part is polished. The polishing step is carried out at least once. The polishing step includes a final finish polishing process in which a final finish medium which is free from abrasive grain or which consists of a synthetic resin base material and is free from abrasive grain or which is made by binding abrasive grain of not more than 10 wt % and a synthetic resin binding material together and is free from alumina is used as the medium.

16 Claims, 12 Drawing Sheets

(56) References Cited

U.S. PATENT DOCUMENTS

| | | | | | |
|---|---|---|---|---|---|
| 2,994,165 | A * | 8/1961 | Brevik | B24B 31/027 | 366/220 |
| 3,540,156 | A * | 11/1970 | Kanouse | B24C 3/26 | 451/34 |
| 3,579,933 | A * | 5/1971 | Snell | B24B 31/073 | 451/34 |
| 5,690,538 | A * | 11/1997 | Haas | A44C 27/00 | 29/896.41 |
| 5,724,208 | A | 3/1998 | Yahata | | |
| 5,760,999 | A | 6/1998 | Yahata | | |
| 6,367,134 | B1 * | 4/2002 | Sanada | H01G 13/006 | 29/25.42 |
| 7,303,691 | B2 * | 12/2007 | Kozasa | B24B 37/044 | 216/89 |
| 2001/0003696 | A1 * | 6/2001 | Kawasaki | B24B 1/00 | 451/34 |
| 2003/0186626 | A1 * | 10/2003 | Carpenter | B24C 3/088 | 451/34 |
| 2012/0252322 | A1 * | 10/2012 | Ishigami | B22F 3/225 | 451/32 |

FOREIGN PATENT DOCUMENTS

| | | | |
|---|---|---|---|
| JP | 10-074350 | A | 3/1998 |
| JP | 2003-02512 | A | 1/2003 |

* cited by examiner 10
11
12
16
17
19
30
31
32
36
37
39
40
41
42
43
44
45
47
48
50
52
60
61
62
W

SURFACE TREATMENT METHOD FOR METAL PARTS

CROSS-REFERENCE TO RELATED APPLICATIONS

This application is based upon and claims the benefit of priority from the prior Japanese Patent Application No. 2016-48105 filed on Mar. 11, 2016, the entire contents of both of which are incorporated herein by reference.

BACKGROUND

1. Technical Field

The present invention relates to a surface treatment method for metal parts.

2. Related Art

Spacers interposed between magnetic discs of a hard disc device are conventionally formed into a predetermined shape by pressing, cutting or the like, and barrel polishing is thereafter carried out for the spacers in order that burrs may be removed from the spacers. In the barrel polishing, finely divided or fine powder is produced from the spacers and abrasives, and a pressing force applied during polishing causes the fine powder to pierce into surfaces of the spacers. Accordingly, ultrasonic cleaning is carried out during or after the polishing in order that the fine powder may be removed from the spacers. However, micron-sized recesses and grooves may remain on the surfaces of the spacers due to the polishing. The fine powder enters into the recesses and the grooves, so that it would be difficult to completely remove the fine powder by the ultrasonic cleaning. In particular, since fine powder of alumina ($Al_2O_3$) abrasive grain is so hard that alumina cannot easily be removed completely, alumina is regarded as unfavorable in industry, and process control by use of alumina-free abrasives is desired.

Japanese Patent Application Publication No. JP-A-H10-074350 discloses, as a countermeasure, a surface treatment method in which a metal or ceramic film is formed on the surfaces of the spacers so as to confine the fine powder adherent to the surfaces of the spacers inside the film. According to this method, the fine powder can be prevented from being exposed on the surfaces of the spacers while remaining.

However, the above-described surface treatment method confining the fine powder adhered to the spacer surfaces inside the film has a problem of high costs.

SUMMARY

Therefore, an object of the invention is to provide a surface treatment method for metal parts, which can reliably remove the fine powder from the metal part surfaces at lower costs.

The present invention provides a surface treatment method for metal parts, including a polishing step of supplying and discharging a cleaning liquid into and from a barrel tub while mass including a metal part and a medium is caused to flow in the barrel tub, thereby polishing a surface of the metal part. The polishing step is carried out at least once. The at least one polishing step includes a final finish polishing process in which a final finish medium which is free from abrasive grain or which consists of a synthetic resin base material and is free from abrasive grain or which is made by binding abrasive grain of not more than 10 wt % and a synthetic resin binding material together and is free from alumina is used as the medium.

In the invention claimed in claims of this application, "free from alumina" defines that a binding material or abrasive grain does not intentionally contain any alumina as a polishing material.

The metal parts can be finished with smaller surface roughness in the final finish polishing process when the final finish media do not contain any abrasive grain. Furthermore, the metal parts and the final finish media are difficult to produce fine powder. Even if fine powder is produced, the powder is less likely to adhere to the surfaces of the metal parts since the surface roughness of the metal parts is rendered smaller in the final finish polishing. Therefore, fine powder is reliably removed from the surfaces of the metal parts by the cleaning force of the cleaning liquid. Furthermore, alumina does not remain on the surfaces of the metal parts when a final finish medium which consists of a synthetic resin base material and is free from abrasive grain or which is made by binding abrasive grain of not more than 10 wt % and a synthetic resin binding material together and is free from alumina is used as the medium in the final finish polishing process. Accordingly, alumina free metal parts can be realized. According to the surface treatment method of the invention, cost reduction can be achieved since no plating process is required.

The final finish medium may contain silica as a main component and may be free from abrasive grain having a higher hardness than silica. According to this composition, the metal parts can be finished with smaller surface roughness in the final finish polishing process since the silica serving as the main component of the medium has a small polishing force. Furthermore, fine powder of silica produced during polishing is less likely to pierce into the metal parts since the powder is not sharp in shape.

A final finish barrel tub may be used as the barrel tub in the final finish polishing process. In this case, the final finish barrel tub is rotatably supported by a pair of substantially horizontal hollow support shafts coaxially arranged. The final finish barrel tub causes the mass to flow therein like an avalanche. The cleaning liquid may be supplied through one of the support shafts into the barrel tub and discharged through the other support shaft from the barrel tub. According to this construction, the structure of the barrel polishing machine can be simplified since the hollow support shaft to support the barrel tub is also used as cleaning liquid supply/discharge paths.

A semi-finish polishing process may be carried out prior to the final finish polishing process. A semi-finish barrel tub may be used as the barrel tub in the semi-finish polishing process. In this case, the semi-finish barrel tub causes a vortex flow in the mass by rotating a semi-finish rotary disk disposed to close a lower end opening of a cylindrical semi-finish fixed tub. According to this construction, scratches and asperities formed on the metal part due to deburring, rounding or the like in a rough finish polishing process can efficiently be smoothed since the polishing force of the barrel tub causing a vortex flow in the mass is larger than the force of the barrel tub causing an avalanche flow.

In the semi-finish barrel tub, the rotary disk may be rotated in sliding contact with a lower edge of the fixed tub. According to this construction, semi-finish media each having a small diameter can be used since the semi-finish media have no possibility of being caught or bitten between the semi-finish fixed tub and the semi-finish rotary disk. Consequently, the metal part can be finished with smaller surface roughness by polishing the metal part using the semi-finish media each having the small diameter.

A rough finish polishing process may be carried out prior to the semi-finish polishing process. A rough finish barrel tub may be used as the barrel tub in the rough finish polishing process. In this case, the rough finish barrel tub includes a cylindrical rough finish fixed tub and a rough finish rotary disk disposed to close a lower end opening of the rough finish fixed tub and rotated in non-contact with the rough finish fixed tub. According to this construction, deburring, rounding and the like can efficiently be carried out since the medium having a large diameter can be used in the rough finish polishing process.

A semi-finish polishing process may be carried out prior to the final finish polishing process. A semi-finish medium may be used as the medium in the semi-finish polishing process. In this case, the semi-finish medium is free from abrasive grain having a higher hardness than silica. As a result, an amount of fine powder produced from the media can be reduced and the surface roughness of the metal parts can be rendered smaller in the semi-finish polishing process.

A semi-finish polishing process may be carried out prior to the final finish polishing process. A semi-finish medium made by binding abrasive grain of not more than 30 wt % and a binding material together may be used in the semi-finish polishing process. The binding material of the semi-finish medium may be a synthetic resin. According to this method, since the semi-finish medium is soft and light-weight and is moreover low in the content rate of abrasive grain, the media is less likely to strike alumina or foreign matter into the surfaces of the metal parts.

The abrasive grain of the final finish medium and/or the abrasive grain of the semi-finish medium may comprise any one of silicon carbide, diamond, cubic boron nitride, zircon, zirconia, silica, boron carbide, iron oxide and chromium oxide and also be free from alumina. According to this method, since the abrasive grain of the final finish medium and/or the abrasive grain of the semi-finish medium is free from alumina, no alumina remains on the surfaces of the metal parts after the polishing process.

The binding material of the semi-finish medium may be unsaturated polyester. According to this method, the unsaturated polyester used as the binding material has advantages that it is economical and easy to form.

The abrasive grain of the final finish medium and/or the abrasive grain of the semi-finish medium may have a median diameter of not more than 10 μm. According to this method, the final finish medium is soft and lightweight and, moreover, the metal parts are polished by fine abrasive grain. Accordingly, the surfaces of the metal parts can be fine-grained.

The semi-finish polishing process may be carried out at a plurality of times. The semi-finish medium may have a specific weight which is sequentially rendered smaller in a course of treatment from the first semi-finish polishing process to the final semi-finish polishing process. According to this treating manner, the polishing force is given a higher priority than the surface roughness in the first semi-finish polishing process. The higher priority is transferred to the surface roughness as the semi-finish polishing process progresses. As a result, polishing can efficiently be carried out and the spacers can be finished with smaller surface roughness.

The final finish medium may be formed into a spherical shape and may have a diameter of not more than 3 mm. As a result, the surface roughness of the metal parts can be rendered smaller and production of fine powder from the final finish medium can be suppressed.

A rough finish polishing process may be carried out prior to the semi-finish polishing process. A rough finish medium may be used as the medium in the rough finish polishing process. In this case, the rough finish medium contains abrasive grain having a higher hardness than silica. As a result, deburring, rounding and the like can efficiently be finished in a shorter period of time since the medium containing abrasive grain can be used.

In a process of sequentially proceeding with the rough finish polishing process and the semi-finish polishing process both carried out prior to the final finish polishing process, content rates of abrasive grain contained in the media used in the respective polishing processes may sequentially be lowered. According to this method, since the content rates of the abrasive grain contained in the media is sequentially lowered during the process of proceeding with the polishing process, the flatness of the surfaces of the metal parts can efficiently be improved.

A surface of the metal part may ultrasonically be cleaned after the final finish polishing process. As a result, fine powder can reliably be prevented from remaining on the surfaces of the metal parts.

DETAILED DESCRIPTION

First Embodiment

A first embodiment will be described with reference to FIGS. 1A to 9. The surface treatment method of the embodiment is directed to a metal part of a precision apparatus, such as an annular spacer S interposed between magnetic discs of a hard disc device. In the embodiment, the case where the metal part is the spacer S will be described. The spacer S is formed into a predetermined shape by pressing, cutting or the like and barrel polishing is thereafter applied to the spacer S to remove burrs therefrom, to improve the surface roughness or for another purpose. In the barrel polishing, four types of media Ma, Mb, Mc and Md are used as abrasives.

In a barrel polishing process, finely divided or fine powder is produced from the spacer S and one of the media Ma, Mb, Mc and Md, and a pressing force during polishing causes the fine powder to pierce into the surface of the spacer S. The fine powder is removed from the surface of the spacer S by the surface treatment method of the embodiment. The surface treatment method of the embodiment includes a one-time rough finish polishing process, three times of semi-finish polishing processes, a one-time final finish polishing process and a one-time ultrasonic cleaning process sequentially carried out in this order. Devices or machines executing these processes include, as shown in FIGS. 1A to 1F, one rough finish vortex barrel polishing machine 10, three semi-finish vortex barrel polishing machines 30, one final finish rotary barrel polishing machine 40 and one ultrasonic cleaning machine 60.

<Rough Finish Vortex Barrel Polishing Machine 10>

Figures 1A, 1B, 1C, 1D, 1E, 1F:
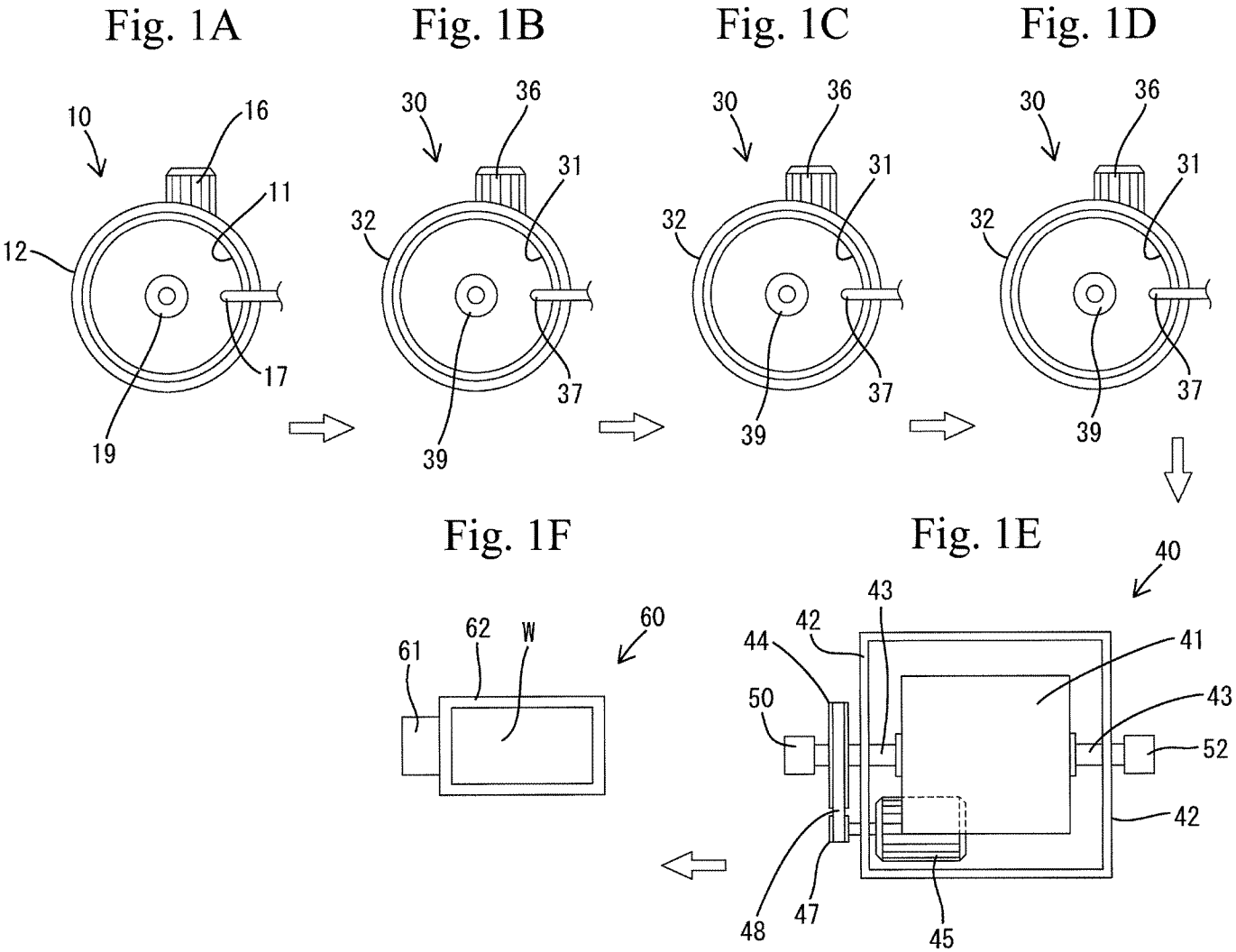
FIGS. 1A to 1F are plan views of machines executing the surface treatment method of an embodiment, showing an arrangement of the machines.
Figure 2:
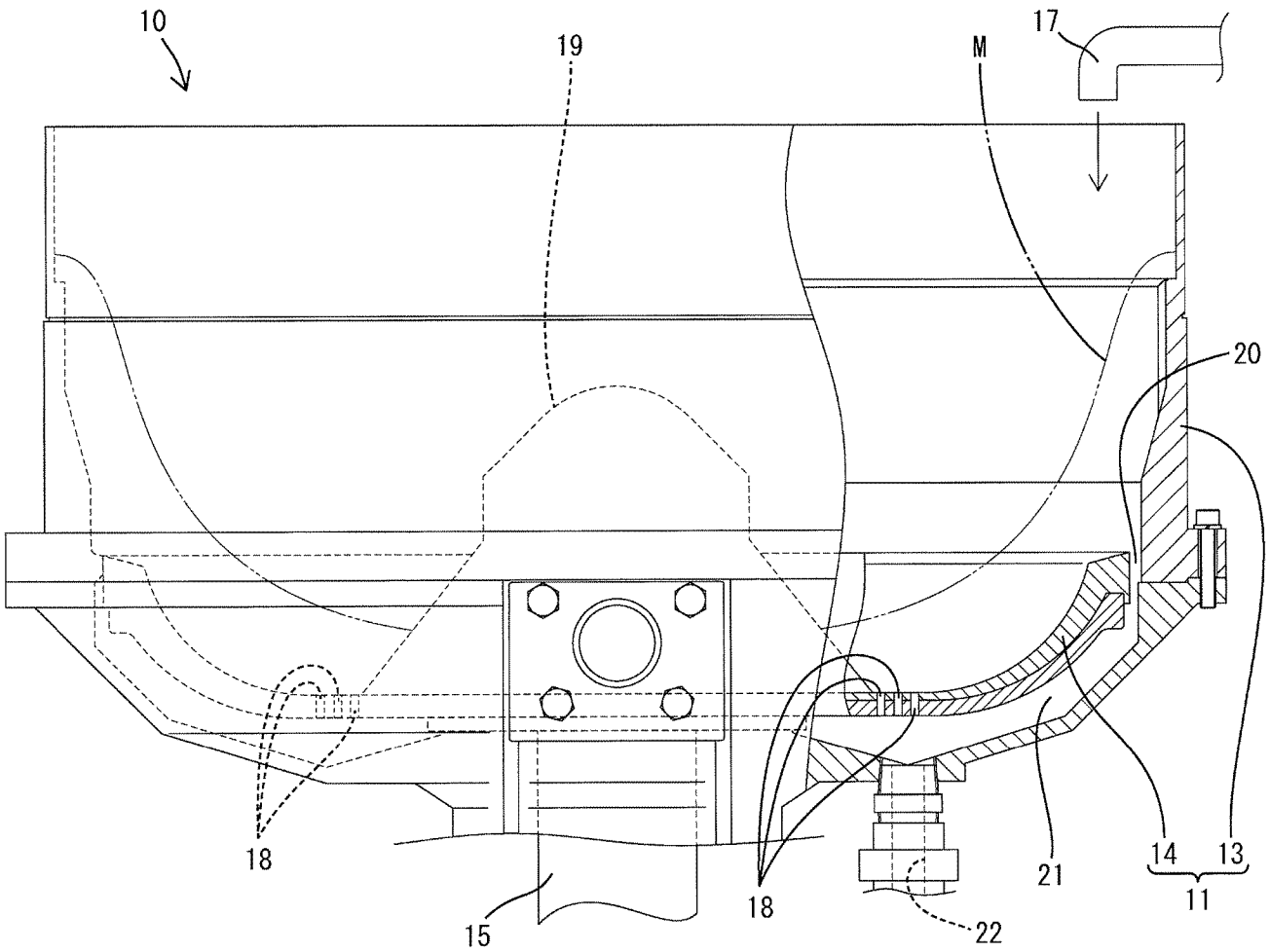
FIG. 2 is a cross sectional view of a rough finish vortex barrel polishing machine.

The rough finish vortex barrel polishing machine 10 includes a rough finish barrel tub 11 having an axis oriented in an up-down direction as shown in FIG. 2. The barrel tub 11 includes a cylindrical rough finish fixed tub 13 supported coaxially by a circular dish-shaped support member 12 in a rotation-prevented state and a dish-shaped rough finish rotary disk 14 disposed so as to close a lower end opening of the fixed tub 13 (so as to extend along a lower edge of the fixed tub 13). The rotary disk 14 is mounted on an upper end of a rotating shaft 15 extending through the support member 12, so as to be rotatable together with the rotating shaft 15. The rotary disk 14 is rotated by a motor 16 (see FIG. 1A). A space is defined by an outer periphery (an underside) of the rotary disk 14 and an inner periphery (an upper surface) of the support member 12, serving as a drainage space 21.

Liquid-supply piping 17 is provided for supplying cleaning liquid W into the barrel tub 11. The liquid-supply piping 17 has a downstream end which is open above the barrel tub 11. The rotary disk 14 has a central part of an upper surface, on which central part a center pole 19 is mounted so as to be rotatable together with the rotary disk 14. The rotary disk 14 also has an area extending along an outer peripheral edge of the center pole 19. The area is formed with a plurality of communication holes 18 which allows the cleaning liquid W and waste liquid to pass therethrough but forbids the spacer S and the medium Ma from passing therethrough. The communication holes 18 communicate between an interior of the barrel tub 11 and the drainage space 21. The communication holes 18 serve as a drainage path through which a liquid in the barrel tub 11 (the cleaning liquid W and waste liquid) is discharged out of the barrel tub 11.

The rotary disk 14 has an upper end disposed to be opposed to an inner periphery of a lower end of the fixed tub 13. However, an outer periphery of the upper end of the rotary disk 14 is not in contact with the inner periphery of the lower end of the fixed tub 13, and a draining slit 20 is open between the outer periphery of the upper end of the rotary disk 14 and the inner periphery of the lower end of the fixed tub 13. The draining slit 20 communicates between the inner space of the barrel tub 11 and the drainage space 21. A drainage 22 having an upper end open to the drainage space 21 is mounted to the support member 12. The draining slit 20 and the drainage 22 also serve as the drainage path through which liquid in the barrel tub 11 is discharged, as well as the communication hole 18. In other words, the cleaning liquid W and the waste liquid in the barrel tub 11 flow through the communication 18 and the draining slit 20 into the drainage space 21, from which the cleaning liquid W and the waste liquid are discharged out of the barrel tub 11 through the drainage 22.

<Semi-Finish Vortex Barrel Polishing Machines 30>

Figure 3:
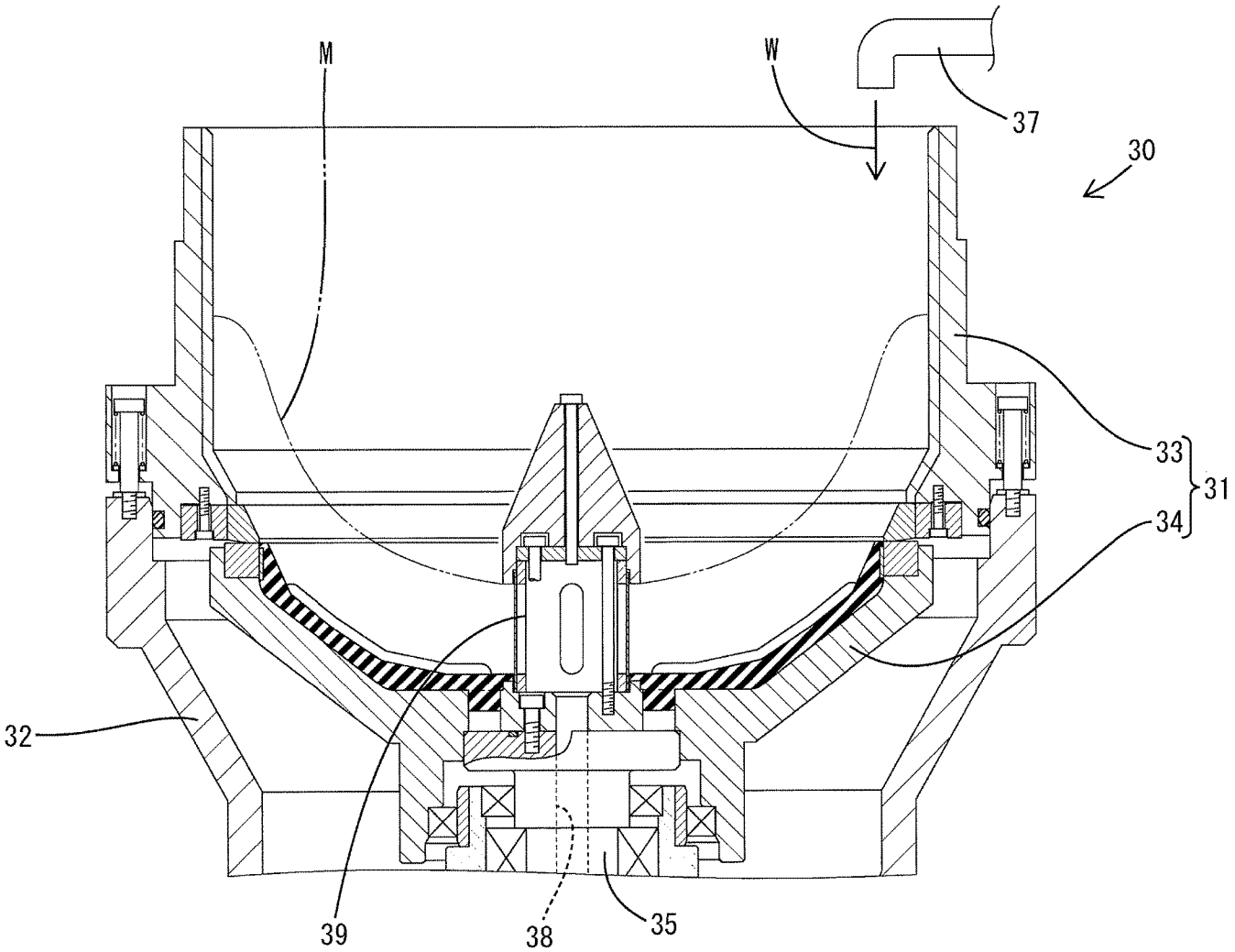
FIG. 3 is a cross sectional view of a semi-finish vortex barrel polishing machine.
Figure 4:
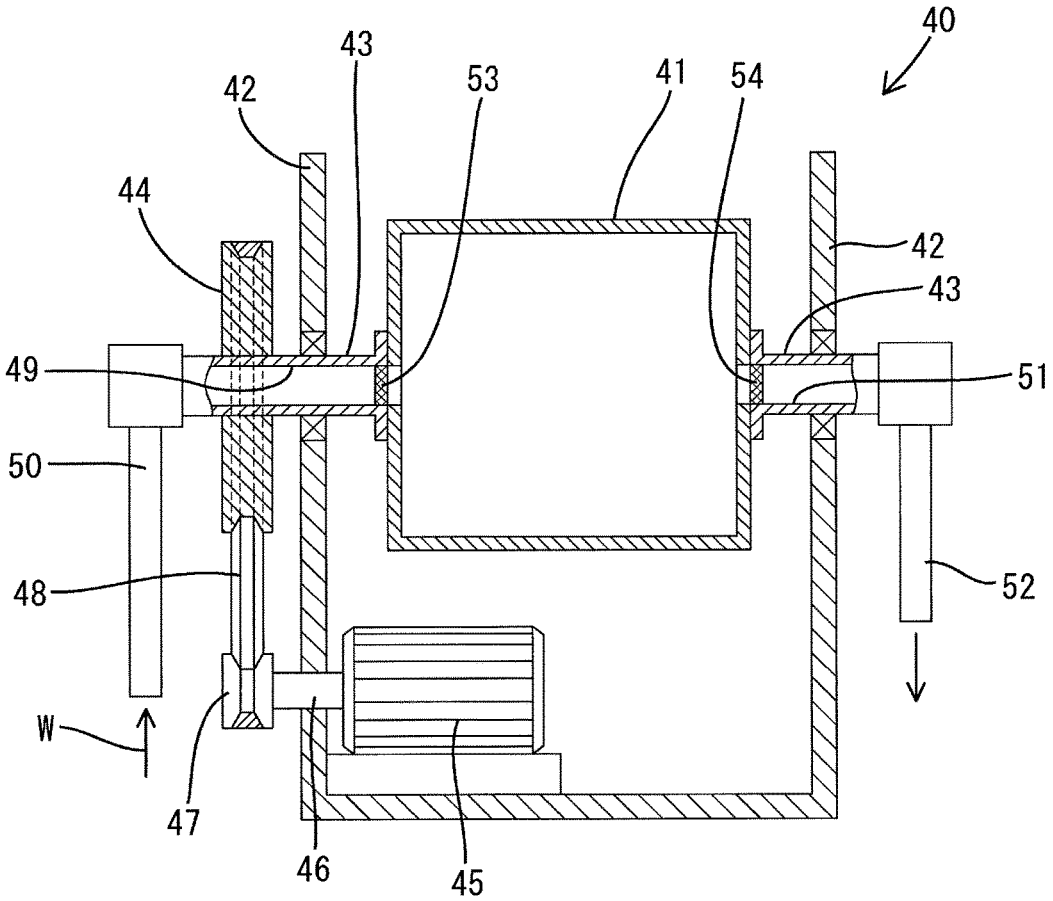
FIG. 4 is a cross sectional view of a final finish rotary barrel polishing machine.
Figure 5:
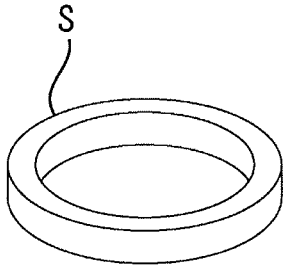
FIG. 5 is a perspective view of a spacer (a metal part)
Figure 6:
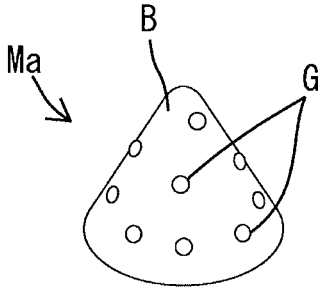
FIG. 6 is a perspective view of a rough finish medium.
Figure 7:
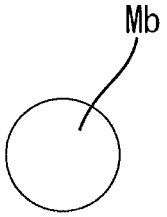
FIG. 7 is a perspective view of a first semi-finish medium.
Figure 8:
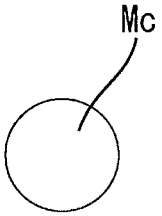
FIG. 8 is a perspective view of a second semi-finish medium.
Figure 9:
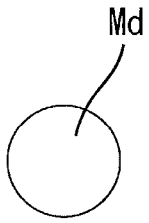
FIG. 9 is a perspective view of a final finish medium.

The three semi-finish vortex barrel polishing machines 30 have the same structure and include semi-finish barrel tubs 31 having axis lines oriented in the up-down direction, respectively, as shown in FIG. 3. Each barrel tub 31 includes a cylindrical semi-finish fixed tub 33 supported coaxially on a cylindrical support member 32 in a rotation-prevented state and a dish-shaped semi-finish rotary disk 34 disposed so as to close a lower end opening of the fixed tub 33 (so as to extend along a lower edge of the fixed tub 33). The rotary disk 34 is mounted on an upper end of a hollow rotating shaft 35 so as to be rotatable together with the rotating shaft 35 and is driven by a motor 36 (see FIG. 1).

Liquid-supply piping 37 is provided for supplying cleaning liquid W into the barrel tub 31. The liquid-supply piping 37 has a downstream end which is open above the barrel tub 31. The rotating shaft 35 has an interior serving as a drainage 38. The drainage 38 has an upper end which is open to a central upper surface of the rotary disk 34. The upper end of the drainage 38 is provided with a filter 39 which forbids the spacer S, the first and second semi-finish media Mb and Mc and the final finish medium Md from passing therethrough but allows a liquid such as the cleaning liquid W to pass therethrough. The drainage 38 serves as a drainage path through which a liquid (the cleaning liquid W and waste liquid) in the barrel tub 31 is discharged. The rotary disk 34 is rotated while an upper edge thereof is brought into sliding contact with a lower edge of the fixed tub 33. Accordingly, no space allowing the liquid in the barrel tub 31 to flow out of the barrel tub 31 is defined between the upper edge of the rotary disk 34 and the lower edge of the fixed tub 33.

<Final Finish Rotary Barrel Polishing Machine 40>

The final finish rotary barrel polishing machine 40 includes a final finish barrel tub 41 having an axis line oriented horizontally. The barrel tub 41 includes a pair of frames 42 on which are rotatably mounted two hollow support shafts 43 disposed coaxially, respectively. The barrel tub 41 is supported on the support shafts 43 so as to be rotatable together with the support shafts 43. A driven pulley 44 is mounted on one of the support shafts 43 so as to be rotatable together with the one support shaft 43. A V belt 48 extends between the driven pulley 44 and a driving pulley 47 secured to a drive shaft 46 of a motor 45. The barrel tub 41 is configured to be rotated upon drive of the motor 45.

The support shaft 43 has an interior serving as a liquid supply inlet 49. The liquid supply inlet 49 has an upstream end to which a downstream end of the liquid supply piping 50 is connected. A downstream end of the liquid supply inlet 49 communicates with the interior of the barrel tub 41. A filter 53 is provided on the downstream end of the liquid supply inlet 49. The filter 53 forbids the spacer S and the final finish medium Md from passing therethrough but allows the cleaning liquid W to flow therethrough. The other support shaft 43 has an interior serving as a drain hole 51. The drain hole 51 has an upstream end communicating with the interior of the barrel tub 41 and a downstream end to which an upstream end of drain piping 52 is connected. A filter 54 is provided on the upstream end of the drain hole 51. The filter 54 prevents the spacer S and the medium Md from passing therethrough but allows the cleaning liquid W and waste liquid (not shown) to pass therethrough. The cleaning liquid W is supplied from the liquid supply piping 50 through the liquid supply inlet 49 into the barrel tub 41 and is discharged through the drain hole 51 and the drain piping 52.

<Ultrasonic Cleaning Machine 60>

The ultrasonic cleaning machine 60 includes an ultrasonic generator 61 and a container 62 storing the cleaning liquid W containing water for conducting ultrasonic waves, an organic solvent and the like. When the spacers S are immersed in the cleaning liquid W and ultrasonic waves are generated, fine bubbles are produced in the cleaning liquid W and broken in a short time (cavitation). Cavitation bubble energy causes finely divided powder to rise upward from surfaces of the spacers S.

<Rough Finish Medium Ma>

The rough finish medium Ma (see FIG. 6) used in a rough finish polishing process is made by binding abrasive grain G comprising zircon with a synthetic resin binding material B (bond). The abrasive grain G is amorphous as a whole and has curved corners. The rough finish medium Ma is conical in shape as a whole and has a height and a diameter both of which are larger than an opening dimension of the draining slit 20 between the upper edge of the rotary disk 14 and the lower edge of the fixed tub 13. The rough finish medium Ma is used to deburr the spacers S and to round corner edges of the spacers S. Furthermore, cutting marks and press marks are removed which are produced on the spacers S in the processes prior to the rough finish process.

<First Semi-Finish Medium Mb>

The first semi-finish medium Mb (see FIG. 7) used in a first semi-finish polishing process consists of a base material containing alumina as a main component and silica and does not contain abrasive grain. More specifically, the first semi-finish medium Mb is a spherical ceramic medium. The term "ceramic" is an address term to identify a type of the base material. A weight ratio of alumina ranges from 80 to 95 weight percent (wt %) and a weight ratio of silica ranges from 3 to 18 wt %. The first semi-finish medium Mb contains a small amount of oxide as well as alumina and silica. The first semi-finish medium Mb is spherical in shape and has a diameter of 3 mm in the embodiment, which diameter is smaller than the height and the diameter of the rough finish medium Ma. The diameter of the first semi-finish medium Mb is desirably not more than 3 mm. When the diameter is not more than 3 mm, surface roughness of the spacers S can be rendered small and an amount of fine powder produced by the first semi-finish medium Mb during polishing can be reduced. The first semi-finish medium Mb has a larger specific weight than the rough finish medium Ma.

Furthermore, the first semi-finish medium Mb which does not contain abrasive grain has a smaller polishing force than the rough finish medium Ma. However, the space S has a higher surface roughness after polishing by use of the first semi-finish medium Mb than after polishing by use of the rough finish medium Ma. More specifically, the surface of the spacer S has a higher smoothness when the spacer S is polished using the first semi-finish medium Mb than when the spacer S is polished using the rough finish medium Ma.

<Second Semi-Finish Medium Mc>

The second semi-finish medium Mc (see FIG. 8) used in a second semi-finish polishing process consists of a base material containing alumina and silica as main components and does not contain abrasive grain. More specifically, the second semi-finish medium Mc is a spherical ceramic medium. The term "ceramic" is an address term to identify a type of the base material. A weight ratio of alumina ranges from 50 to 80 wt % and a weight ratio of silica ranges from 15 to 45 wt %. The second semi-finish medium Mc contains a small amount of oxide as well as alumina and silica. The second semi-finish medium Mc has a diameter of 3 mm in the embodiment, which diameter is equal to that of the first semi-finish medium Mb. The diameter of the second semi-finish medium Mc is desirably not more than 3 mm. When the diameter is not more than 3 mm, the surface roughness of the spacers S can be rendered small and an amount of fine powder produced by the second semi-finish medium Mc during polishing can be reduced. Furthermore, the second semi-finish medium Mc has a smaller specific weight than the first semi-finish medium Mb.

Furthermore, since silica has a lower grinding power and a lower sharpness than alumina, the second semi-finish medium Mc containing alumina and silica as the main components has a smaller polishing force than the first semi-finish medium Mb containing alumina as the main component. However, the space S has a smaller surface roughness after polishing by use of the second semi-finish medium Mc than after polishing by use of the first semi-finish medium Mb. More specifically, the surface of the spacer S has a higher smoothness when the spacer S is polished using the second semi-finish medium Mc than when the spacer S is polished using the first semi-finish medium Mb.

<Final Finish Medium Md>

The final finish medium Md (see FIG. 9) used in a third semi-finish polishing process and a final finish polishing process consists of a base material containing silica as a main component and does not contain abrasive grain. More specifically, the final finish medium Md is a spherical ceramic medium as the second semi-finish medium Mc. The term "ceramic" is an address term to identify a type of the base material. A weight ratio of silica ranges from 70 to 100 wt %. A weight ratio of alumina ranges from 0 to 25 wt %. When a total ratio of silica and alumina is set to 95 wt % and the remainder is a clay component, the final finish medium Md can easily be made. The final finish medium Md has a diameter of 3 mm in the embodiment, which diameter is equal to those of the first and second semi-finish media Mb and Mc. The diameter of the final finish medium Md is desirably not more than 3 mm. When the diameter is not more than 3 mm, the surface roughness of the spacers S can be rendered small and an amount of fine powder produced by the final finish medium Md during polishing can be reduced. Furthermore, the final finish medium Md has a smaller specific weight than the second semi-finish medium Mc.

Furthermore, since silica has a lower grinding power and a lower sharpness than alumina as described above, the final finish medium Md containing silica as the main component has a smaller polishing force than the second semi-finish medium Mc containing alumina and silica as the main components. However, the spacer S has a smaller surface roughness after polishing by use of the final finishing medium Md than after polishing by use of the second semi-finish medium Mc. More specifically, the surface of the spacer S has a higher smoothness when the spacer S is polished using the final finish medium Md than when the spacer S is polished using the second semi-finish medium Mc.

<Surface Treatment Process>

Next, a surface treatment process in the manufacture of the spacers S will be described. After spacers S each having a predetermined shape have been made by pressing or cutting, lapping polishing is applied to either one or both of two sides of the spacer S in order that the spacers S may have a uniform thickness. In the lapping polishing process, polishing is carried out by reciprocating or rotating a polishing material (not shown) having a planar polishing surface while pressing the polishing material on the spacers S.

Subsequently, the rough finish polishing process is carried out for the purposes of deburring and rounding the spacers S (forming tapered surfaces and curved surfaces on corner edges), and the lapping polishing process is carried out for either one or both of two sides of the spacer S in order that the two sides of the spacer S may be rendered parallel to each other. Next, the semi-finish polishing process is carried out thrice and the final finish polishing process is carried out once in order that the surface roughness of the spacers S may be rendered small. The lapping polishing process to render the thicknesses of the spacers S uniform may or may not be carried out depending upon the accuracy required for the spacers S. Furthermore, the rough finish polishing process and the lapping polishing process to render the sides of the spacer S parallel to each other also may or may not be carried out depending upon the accuracy required for the spacers S.

<Rough Finish Polishing Process>

In the rough finish polishing process, the spacers S and the rough finish media Ma are put into the barrel tub 11 of the rough finish vortex barrel polishing machine 10. The rough finish rotary disk 14 is rotated while the cleaning liquid W is supplied into the barrel tub 11. A mass M of the spacers S and the rough finish media Ma is caused to flow as vortex flow in the barrel tub 11, so that the surfaces of the spacers S are polished by the rough finish media Ma.

The vortex barrel polishing machine 10 produces the vortex of the mass M in the barrel tub 11. Accordingly, the vortex barrel polishing machine 10 has a larger polishing force than the final finish rotary barrel polishing machine 40. Furthermore, the rough finish medium Ma has a larger polishing force than any one of the first semi-finish medium Mb, the second semi-finish medium Mc and the final finish medium Md. Accordingly, the polishing force in the rough finish polishing process is the largest in the first to fifth polishing processes. The deburring and the rounding of the spacers S and the like are efficiently carried out by the large polishing force.

However, since the polishing force is large, the finely divided powder or fine powder produced from the spacers S by the polishing is likely to pierce into the surfaces of the spacers S. Furthermore, since the polishing force is large, asperities formed on the surfaces of the spacers S with execution of the rough finish polishing process are the largest in the first to fifth polishing processes. Accordingly, the fine powder produced from the spacers S is likely to be caught by the asperities. Moreover, since rough finish media Ma contain abrasive grain G, fine powder produced from the abrasive grain G is also likely to pierce into the surfaces of the spacers S and to be caught by the asperities. In the rough finish polishing process, the cleaning liquid W is continuously supplied into the barrel tub 11 and waste liquid containing fine powder is continuously discharged. However, since the asperities are large, the fine powder which is caught by the asperities thereby to remain cannot sufficiently be removed only by the cleaning with the cleaning liquid W.

<First Semi-Finish Polishing Process>

In view of the above-described problem, a first semi-finish polishing process is carried out after the rough finish polishing process. In the first semi-finish polishing process, the spacers S and the first semi-finish media Mb are put into the barrel tub 31 of the vortex barrel polishing machine 30. The semi-finish rotary disk 34 is rotated with the cleaning liquid W being supplied into the barrel tub 31. The mass M of the spacers S and the first semi-finish media Mb is then caused to flow as vortex flow in the barrel tub 31, so that the surfaces of the spacers S are polished by the first semi-finish media Mb.

The semi-finish vortex barrel polishing machine 30 also causes the mass M in the barrel tub 31 to flow as the vortex flow in the same manner as the rough finish vortex barrel polishing machine 10. Accordingly, the vortex barrel polishing machine 30 has a larger polishing force than the final finish rotary barrel polishing machine 40. Furthermore, the first semi-finish medium Mb has a larger polishing force than the second semi-finish medium Mc and the final finish medium Md. Accordingly, the polishing force in the first semi-finish polishing process is the second-largest after the rough finish polishing process in the first to fifth polishing processes. The asperities of the spacers S produced in the rough finish polishing process are rendered smaller by the large polishing force with the result that the surfaces of the spacers S can efficiently be smoothed.

However, as the polishing force is large, an amount of fine powder produced from the spacers S is large. Furthermore, since the first semi-finish medium Mb contains alumina as the main component, fine powder of alumina is produced from the first semi-finish medium Mb. Although the asperities on the surfaces of the spacers S are rendered smaller, the fine powder of the spacers S and alumina unavoidably pierce into the surfaces of the spacers S or are caught by the asperities. In the first semi-finish polishing process, too, the cleaning liquid W is continuously supplied into the barrel tub 31 and waste liquid containing fine powder is continuously discharged as in the rough finish polishing process. However, the fine powder which has pierced into the surfaces of the spacers S cannot completely be removed only by the cleaning with the cleaning liquid W.

<Second Semi-Finish Polishing Process>

In view of the above-described problem, a second semi-finish polishing process is carried out after the first semi-finish polishing process. In the second semi-finish polishing process, the spacers S and the second semi-finish media Mc are put into the barrel tub 31 of the vortex barrel polishing machine 30. The semi-finish rotary disk 34 is rotated with the cleaning liquid W being supplied into the barrel tub 31. The mass M of the spacers S and the second semi-finish media Mc is then caused to flow as vortex flow in the barrel tub 31, so that the surfaces of the spacers S are polished by the second semi-finish media Mc.

The polishing force of the semi-finish vortex barrel polishing machine 30 is larger than the polishing force of the final finish rotary barrel polishing machine 40 as described above. Furthermore, the polishing force of the second semi-finish medium Mc is smaller than the polishing force of the first semi-finish medium Mb but is larger than the polishing force of the final finish medium Md. Accordingly, the polishing force in the second semi-finish polishing process is the third-largest after the first semi-finish polishing process in the first to fifth polishing processes. The asperities of the spacers S rendered smaller in the first semi-finish polishing process are rendered further smaller by the polishing force of the barrel polishing machine 30 and the polishing force of the second semi-finish medium Mc, with the result that the surfaces of the spacers S are further smoothed.

The polishing force of the second semi-finish polishing process is smaller than the polishing force of the rough finish polishing process and the polishing force of the first semi-finish polishing process. However, fine powder is produced from the spacers S as long as the polishing is carried out. Furthermore, since the second semi-finish medium Mc contains alumina, fine powder of alumina is also produced.

Although the asperities on the surfaces of the spacers S are rendered smaller than in the first semi-finish polishing process, the fine powder of the spacers S and alumina unavoidably pierce into the surfaces of the spacers S or are caught by the asperities. In the second semi-finish polishing process, too, the cleaning liquid W is continuously supplied into the barrel tub 31 and waste liquid containing fine powder is continuously discharged as in the rough finish polishing process and the first semi-finish polishing process. However, the fine powder which has pierced into the surfaces of the spacers S cannot completely be removed only by the cleaning with the cleaning liquid W.

<Third Semi-Finish Polishing Process>

In view of the above-described problem, a third semi-finish polishing process is carried out after the second semi-finish polishing process. In the third semi-finish polishing process, the spacers S and the final finish media Md are put into the barrel tub 31 of the vortex barrel polishing machine 30. The semi-finish rotary disk 34 is rotated with the cleaning liquid W being supplied into the barrel tub 31. The mass M of the spacers S and the final finish media Md is then caused to flow as vortex flow in the barrel tub 31, so that the surfaces of the spacers S are polished by the final finish media Md.

The polishing force of the semi-finish vortex barrel polishing machine 30 is larger than the polishing force of the final finish rotary barrel polishing machine 40 as described above. The polishing force of the final finish medium Md used in the third semi-finish polishing process is smaller than the polishing force of the rough finish medium Ma, the polishing force of the first semi-finish medium Mb and the polishing force of the second semi-finish medium Mc. Accordingly, the polishing force in the third semi-finish polishing process is the fourth-largest after the second semi-finish polishing process in the first to fifth polishing processes. The asperities of the spacers S rendered smaller in the second semi-finish polishing process are rendered further smaller by the relatively smaller polishing force, with the result that the surfaces of the spacers S are further smoothed.

The polishing force of the third semi-finish polishing process is smaller than the polishing force of the rough finish polishing process, the polishing force of the first semi-finish polishing process and the polishing force of the second semi-finish polishing process. However, as long as the polishing is carried out, fine powder is produced from the spacers S though an amount of fine powder produced is small. Although the asperities on the surfaces of the spacers S are rendered further smaller by the second semi-finish polishing process, a small amount of fine powder of the spacers S cannot completely be avoided from piercing into the surfaces of the spacers S or from being caught by the asperities thereby to remain. In the third semi-finish polishing process, too, the cleaning liquid W is continuously supplied into the barrel tub 31 and waste liquid containing fine powder is continuously discharged as in the rough finish polishing process and the first and second semi-finish polishing processes. The fine powder which has pierced into the surfaces of the spacers S cannot completely be removed only by the cleaning with the cleaning liquid W.

<Final Finish Polishing Process>

In view of the above-described problem, a final finish polishing process is carried out after the third semi-finish polishing process. In the final finish polishing process, the spacers S and the final finish media Md are put into the barrel tub 41 of the final finish rotary barrel polishing machine 40. The barrel tub 41 is then rotated with the cleaning liquid W being supplied into the barrel tub 41. The mass M (not shown) of the spacers S and the final finish media Md is then caused to flow like an avalanche in the barrel tub 41, so that the surfaces of the spacers S are polished by the final finish media Md.

The final finish media Md used in the final finish polishing process is the same as that used in the third semi-finish polishing process. The final finish rotary barrel polishing machine 40 has a smaller polishing force than the semi-finish vortex barrel polishing machine 30. More specifically, the polishing force of the final finish processing process is the smallest in the five polishing processes and is reduced to about one tenth of the polishing force of the third semi-finish polishing process. By the small polishing force, an extremely small amount of asperity remaining after execution of the third semi-finish polishing process is smoothed almost completely with the result that the surfaces of the spacers S are smoothed to reach a target surface roughness (for example, Ra 0.02 μm).

An amount of fine powder produced from the spacers S is extremely small since the polishing force of the final finish polishing process is the smallest in the first to fifth polishing processes. Moreover, in the final finish rotary barrel polishing machine 40 which causes the mass M to flow like an avalanche, the pressing force the final finish media Md applied to the spacers S is smaller than in the vortex barrel polishing machines 10 and 30. Accordingly, fine powder does not pierce into the surfaces of the spacers S. Furthermore, in the final finish polishing process, too, the cleaning liquid W is continuously supplied into the barrel tub 41 and waste liquid containing fine powder is continuously discharged as in the rough finish polishing process and the first to third semi-finish polishing processes, and accordingly, there is no possibility that the fine powder remains on the surfaces of the spacers S.

<Ultrasonic Cleaning Process>

The spacers S are immersed in the cleaning liquid W of the ultrasonic cleaning device 60 after the final finish polishing process, and the ultrasonic generator 61 starts up. Generation and rupture of fine bubbles are repeated in a short time in the cleaning liquid W (cavitation), with the result that cavitation energy is transmitted to the spacers S. Even if fine powder remains on the spacers S after execution of the final finish polishing process, the fine powder is removed from the spacers S by the cavitation energy. The cleaning liquid W may be identical with the cleaning liquid W used in the processes starting from the above-described rough finish polishing process and ending at the final finish polishing process. Alternatively, the cleaning liquid W may be pure water, RO water filtered through a reverse osmosis membrane, or the like.

<Comparison with Different Polishing Processes>

In the foregoing embodiment, five polishing processes are carried out with the result that the surface roughness of the spacer S can finally be reduced to Ra 0.02 μm. TABLE 1 shows three polishing experiments conducted as comparative examples with respect to the foregoing embodiment. In the first polishing experiment, a polishing process corresponding to the final finish polishing process in the foregoing embodiment was eliminated, and the rough finish polishing process and the first to third semi-finish polishing processes were carried out under the same conditions as those in the foregoing embodiment respectively. The surface roughness of the spacer S obtained by the first polishing experiment is Ra 0.04 μm. This result shows that the surface of the spacer S has a higher smoothness in the polishing method of the foregoing embodiment than in the first polishing experiment.

Furthermore, in the second polishing experiment, the rough finish polishing process and the first to third semi-finish polishing processes were carried out under the same conditions as those in the foregoing embodiment respectively. Additionally, a final finish polishing process differing from that in the embodiment was carried out. A medium (not shown) made from the same material as the final finishing medium Md in the embodiment was used in the final finish polishing process of the second polishing experiment. However, the medium used in the final finish polishing process of the second polishing experiment had a diameter of 2 mm, which value was smaller than the final finishing medium Md of the foregoing embodiment. Furthermore, the semi-finish vortex barrel polishing machine 30 was used as the barrel polishing machine in the final finish polishing process as well as in the semi-finish polishing process, and the final finish rotary barrel polishing machine 40 used in the final finish polishing process in the embodiment was not used in the second polishing experiment. The surface roughness of the spacer S obtained by the second polishing experiment is Ra 0.03 μm. This result shows that the surface of the spacer S has a higher smoothness in the polishing method of the embodiment than in the second polishing experiment.

In the third polishing experiment, the rough finish polishing process and the first to third semi-finish polishing processes were carried out under the same conditions as those in the foregoing embodiment respectively. Additionally, a final finish polishing process differing from that in the embodiment was carried out. A medium (not shown) made from the same material as the final finishing medium Md in the embodiment was used in the final finish polishing process of the third polishing experiment. However, the medium used in the final finish polishing process of the third polishing experiment had a diameter of 4 mm, which value was larger than the final finishing medium Md of the foregoing embodiment. Furthermore, a barrel polishing machine which was the same as the final finish rotary barrel polishing machine 40 in the embodiment was used in the third polishing experiment. The surface roughness of the spacer S obtained by the third polishing experiment is Ra 0.03 μm, which value is the same as obtained in the second polishing experiment. This result shows that the surface of the spacer S has a lower smoothness in the third polishing experiment than in the polishing method of the foregoing embodiment.

TABLE 1

| | | Polishing process 1 |
|---|---|---|
| Pre-polishing | | |
| First polishing experiment | Barrel polishing machine | Rough finish vortex barrel polishing machine |
| | Medium | Ma |
| | Polishing time | 8 hrs. |
| | Cleaning liquid | Continuous supply/discharge |
| Second polishing experiment | Barrel polishing machine | Rough finish vortex barrel polishing machine |
| | Medium | Ma |
| | Polishing time | 8 hrs. |
| | Cleaning liquid | Continuous supply/discharge |
| Third polishing experiment | Barrel polishing machine | Rough finish vortex barrel polishing machine |
| | Medium | Ma |
| | Polishing time | 8 hrs. |
| | Cleaning liquid | Continuous supply/discharge |
| First embodiment | Barrel polishing machine | Rough finish vortex barrel polishing machine |
| | Medium | Ma |
| | Polishing time | 8 hrs. |
| | Cleaning liquid | Continuous supply/discharge |

TABLE 1-continued

| | | Polishing process 2 | 3 | 4 |
|---|---|---|---|---|
| Pre-polishing | | | | |
| First polishing experiment | Barrel polishing machine | Semi-finish vortex barrel polishing machine | | |
| | Medium | Mb | Mc | Md |
| | Polishing time | 3 hrs. | 1 hr. | 1 hr. |
| | Cleaning liquid | Continuous supply/discharge | | |
| Second polishing experiment | Barrel polishing machine | Semi-finish vortex barrel polishing machine | | |
| | Medium | Mb | Mc | Md |
| | Polishing time | 3 hrs. | 1 hr. | 1 hr. |
| | Cleaning liquid | Continuous supply/discharge | | |
| Third polishing experiment | Barrel polishing machine | Semi-finish vortex barrel polishing machine | | |
| | Medium | Mb | Mc | Md |
| | Polishing time | 3 hrs. | 1 hr. | 1 hr. |
| | Cleaning liquid | Continuous supply/discharge | | |
| First embodiment | Barrel polishing machine | Semi-finish vortex barrel polishing machine | | |
| | Medium | Mb | Mc | Md |
| | Polishing time | 3 hrs. | 1 hr. | 1 hr. |
| | Cleaning liquid | Continuous supply/discharge | | |

| | | Polishing process 5 |
|---|---|---|
| Pre-polishing | | |
| First polishing experiment | Barrel polishing machine | |
| | Medium | |
| | Polishing time | |
| | Cleaning liquid | |
| Second polishing experiment | Barrel polishing machine | Semi-finish vortex barrel polishing machine |
| | Medium | Md (2 mm) |
| | Polishing time | 1 hr. |
| | Cleaning liquid | Continuous supply/discharge |
| Third polishing experiment | Barrel polishing machine | Final finish rotary barrel polishing machine |
| | Medium | Md (4 mm) |
| | Polishing time | 8 hrs. |
| | Cleaning liquid | Continuous supply/discharge |
| First embodiment | Barrel polishing machine | Final finish rotary barrel polishing machine |
| | Medium | Md (3 mm) |
| | Polishing time | 8 hrs. |
| | Cleaning liquid | Continuous supply/discharge |

| | Foreign matter removal Evaluation | Surface Roughness (Ra) |
|---|---|---|
| pre-polishing | | 0.05 μm |
| First polishing experiment | Δ | 0.04 μm |
| Second polishing experiment | ○ | 0.03 μm |
| Third polishing experiment | ○ | 0.03 μm |
| First embodiment | ◎ | 0.02 μm |

where symbol ◎ designates "best", symbol ○ designates "better" and symbol Δ designates "good".

<Operation and Advantageous Effects>

In the surface treatment method of the foregoing embodiment, the cleaning liquid W is supplied into and discharged from the barrel tub 11, 31 or 41 while the mass M including the spacers S and the media Ma, Mb, Mc or Md is caused to flow in the barrel tub 11, 31 or 41, so that the polishing process for polishing the surfaces of the spacers S is carried out five times (at least once). The final finish medium Md used in the final finish polishing process of the first to fifth polishing processes consists of the base material free from abrasive grain.

According to this surface treatment method, the final finish medium Md used in the final finish polishing process does not contain abrasive grain as described above. As a result, the spacer S can be finished with the smaller surface roughness. Furthermore, in the final finish polishing process, the spacers S and the final finishing media Md are less likely to produce fine powder. Even if fine powder is produced, the powder is less likely to adhere to the surfaces of the spacers S since the surface roughness of the spacers S is rendered smaller in the final finish polishing. Therefore, fine powder is reliably removed from the surfaces of the spacers S by the cleaning force of the cleaning liquid W. According to the surface treatment method of the foregoing embodiment, cost reduction can be achieved since a plating process is not required.

Furthermore, the final finish medium Md contains as the main component silica having a relatively smaller polishing force and does not contain abrasive grain having a higher hardness than silica. Accordingly, the polishing force is small in the final finish polishing. As a result, the spacer S can be finished with the smaller surface roughness. Furthermore, the fine powder of silica is less likely to pierce into the spacers S since the powder is not sharp in shape. Furthermore, since the surfaces of the spacers S are cleaned by the ultrasonic cleaning after the final finish polishing process, the fine powder can reliably be prevented from remaining on the surfaces of the spacers S.

The final finish barrel tub 41 causing the mass M to flow like an avalanche therein is used in the final finish polishing process. The final finish barrel tub 41 is rotatably supported on the paired substantially horizontal hollow support shafts 43 which are coaxially disposed. The cleaning liquid W is supplied through one of the hollow support shafts 43 into the final finish barrel tub 41, and the used cleaning liquid W (waste liquid) is discharged through the other hollow support shaft 43. According to this construction, the structure of the final finish rotary barrel polishing machine 40 can be simplified since the hollow support shafts 43 for supporting the final finish barrel tub 41 is used as supply and discharge paths of the cleaning liquid W respectively.

The semi-finish barrel tub 31 is used in the first to third semi-finish polishing processes carried out prior to the final finish polishing process. The semi-finish barrel tub 31 includes the semi-finish rotary disk 34 which is disposed to close the lower end opening of the cylindrical semi-finish fixed tub 33. The rotary disk 34 is rotated in the first to third semi-finish polishing processes so that the barrel tub 31 causes vortex flows in the mass M. According to this construction, since the barrel tub 31 causing the vortex flows in the mass M has a larger polishing force than the final finish barrel tub 41 causing an avalanche flow, the asperities formed on the spacers S in the rough finish polishing process for deburring and/or rounding the spacers S can efficiently be smoothed.

In the semi-finish barrel tub 31, the semi-finish rotary disk 34 is configured to be rotated in sliding contact with the lower edge of the semi-finish fixed tub 33. Accordingly, the media Mb, Mc and Md have no possibility of being caught or bitten between the fixed tub 33 and the rotary disk 34. As a result, media with a small diameter can be used as the media Mb, Mc and Md. Therefore, the spacers S can be finished with smaller surface roughness by polishing using the media Mb, Mc and Md each having a small diameter.

The media Mb, Mc and Md none of which contain abrasive grain having a higher hardness than silica are used in the first to third semi-finish polishing processes carried out prior to the final finish polishing process. This processing manner can reduce an amount of fine powder produced from the media Mb, Mc and Md in the semi-finish polishing processes and render the surface roughness of the spacers S smaller. Furthermore, each of the media Mb, Mc and Md is formed into a spherical shape (or the shape of a ball) having a diameter (or a diameter) of not more than 3 mm. The diameter and the shape of each medium greatly contribute to rendering the surface roughness of the spacers S smaller. The diameter and the shape of each medium also suppress production of fine powder from the media Mb, Mc and Md.

The semi-finish polishing process is carried out three times in the foregoing embodiment, as described above. Specific weights of the media Mb, Mc and Md are sequentially rendered smaller in the course of treatment from the first semi-finish polishing process to the third semi-finish polishing process. According to this manner, the polishing force is given a higher priority than the surface roughness in the first semi-finish polishing process. The higher priority is transferred to the surface roughness as the semi-finish polishing process progresses. As a result, polishing can efficiently be carried out and the spacers S can be finished with smaller surface roughness.

The rough finish barrel tub 11 is used in the rough finish polishing process carried out prior to the semi-finish polishing processes. The barrel tub 11 includes the cylindrical rough finish fixed tub 13 and the rough finish rotary disk 34 which is disposed to close the lower end opening of the fixed tub 13 and rotated without contact with the fixed tub 13. According to this construction, since the rough finish media Ma each having a large diameter can be used in the rough finish process, deburring, rounding and the like can efficiently be carried out. Moreover, the rough finish media Ma contain abrasive grain having a higher hardness than silica. As a result, deburring, rounding and the like can further efficiently be carried out in a shorter time.

Second Embodiment

Figure 10:
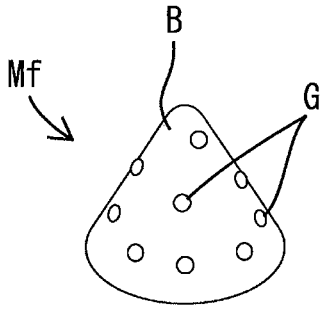
FIG. 10 is a perspective view of the first semi-finish medium.
Figure 11:
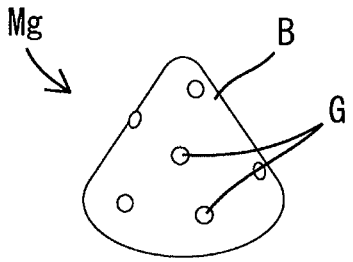
FIG. 11 is a perspective view of the second semi-finish medium.
Figure 12:
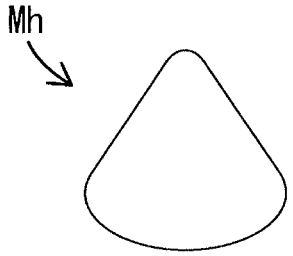
FIG. 12 is a perspective view of the final finish medium.

A second embodiment of the invention will be described with reference to FIGS. 10 to 12. In the second embodiment, detailed description of the same construction, operation and effect as in the first embodiment will be eliminated. A wet type surface treatment method of the second embodiment is directed to treatment of the spacers S as the same metal parts as in the first embodiment and is effective particularly in realizing alumina free surface treatment. In the second embodiment, the wording "free from alumina" or "containing no alumina" signifies that a binding material or abrasive grain does not intentionally contain any alumina as a polishing material. Four types of media Ma, Mf, Mg and Mh are used as polishing materials in the barrel polishing. Fine powder is produced from the spacers S and any one of media Ma, Mf, Mg and Mh in the barrel polishing process. Since the pressing force during polishing pierces the fine powder into the surfaces of the spacers S, the fine powder is removed from the surfaces of the spacers S by the surface treatment method of the second embodiment.

In the surface treatment method of the second embodiment, the rough finish polishing process is carried out once using the single rough finish vortex barrel polishing machine 10 in the same manner as in the first embodiment. The semi-finish polishing process is carried out three times using the three semi-finish vortex barrel polishing machines 30 in the same manner as in the first embodiment. The final finish polishing process is carried out once using the single final finish rotary barrel polishing machine 40 in the same manner as in the first embodiment. The ultrasonic polishing process is carried out once using the single ultrasonic cleaning machine 60 in the same manner as in the first embodiment.

<Rough Finish Medium Ma>

The rough finish medium Ma used in the rough finish polishing process is a plastic medium which is the same as used in the first embodiment. The binding material B (base material) of the rough finish medium Ma comprises unsaturated polyester and contains no alumina. Abrasive grain G comprises zircon. The rough finish medium Ma contains 30 wt % of binding material B and 70 wt % of abrasive grain G.

<First Semi-Finish Medium Mf>

The first semi-finish medium Mf used in the first semi-finish polishing process is a plastic medium obtained by binding the abrasive grain G comprising silica fine powder having a grain diameter (median diameter) of 10 μm and a binding material B (bond) comprising unsaturated polyester and containing no alumina, together. The term "plastic" is an appellative to identify a type of base material (binding material B). The first semi-finish medium Mf is formed into a conical shape and has a bottom diameter of 6 mm and a height of 6 mm.

The first semi-finish medium Mf contains 70 wt % of binding material B and 30 wt % of abrasive grain G. Since the weight percent of abrasive grain G (abrasive grain G rate) in the first semi-finish medium Mf is lower than that of abrasive grain G in the rough finish medium Ma, the first semi-finish medium Mf has a weaker polishing force than the rough finish medium Ma. Accordingly, the surface roughness of spacer S after the polishing is smaller when the spacer S is polished by the first semi-finish medium Mf than when the spacer S is polished by the rough finish medium Ma.

<Second Semi-Finish Medium Mg>

The second semi-finish medium Mg used in the second semi-finish polishing process is a plastic medium obtained by binding the abrasive grain G comprising silica fine powder having a grain diameter (median diameter) of 1 μm and a binding material B (bond) comprising unsaturated polyester and containing no alumina, together. The second semi-finish medium Mg is formed into a conical shape and has a bottom diameter of 6 mm and a height of 6 mm, as shown in FIG. 11.

The second semi-finish medium Mg contains 90 wt % of binding material B and 10 wt % of abrasive grain G. Since the weight percent of abrasive grain G (abrasive grain G rate) in the second semi-finish medium Mg is lower than that of abrasive grain G in the first semi-finish medium Mf, the second semi-finish medium Mg has a weaker polishing force than the first semi-finish medium Mf. Additionally, the second semi-finish medium Mg has a smaller specific weight than the first semi-finish medium Mf. Accordingly, the surface roughness of spacer S after the polishing is smaller when the spacer S is polished by the second semi-finish medium Mg than when the spacer S is polished by the first semi-finish medium Mf.

<Final Finish Medium Mh>

The final finish medium Mh used in a third semi-finish polishing process and a final finish polishing process excludes the abrasive grain G and is composed of only a base material comprising unsaturated polyester and containing no alumina. In other words, the final finish medium Mh is a plastic medium as the first and second semi-finish media Mf and Mg. The term "plastic" is an appellative to identify a type of base material or binding material B. The final finish medium Mh is formed into a conical shape and has a bottom diameter of 6 mm and a height of 6 mm as the first and second semi-finish media Mf and Mg, as shown in FIG. 12.

Since the final finish medium Mh excludes abrasive grain G, the final finish medium Mh has a weaker polishing force than the second semi-finish medium Mg containing abrasive grain G. Accordingly, the surface roughness of spacer S after the polishing is smaller when the spacer S is polished by the final finish medium Mh than when the spacer S is polished by the third semi-finish medium Mg.

<Surface Treatment Process>

Next, a surface treatment process in the manufacture of the spacers S will be described. As in the first embodiment, after the lapping polishing is applied to either one or both of two sides of the spacer S each formed into a predetermined shape by pressing or cutting, the rough finish polishing process is carried out for the purposes of deburring and rounding the spacers S (forming tapered surfaces and curved surfaces on corner edges) and the lapping polishing process is carried out in order that the two sides of the spacer S may be rendered parallel to each other. And thereafter, the semi-finish polishing process is carried out thrice and the final finish polishing process is carried out once in order that the surface roughness of the spacers S may be rendered small.

<Rough Finish Polishing Process>

In the rough finish polishing process, the surfaces of the spacers S are polished by the rough finish media Ma. The vortex barrel polishing machine 10 produces the vortex of the mass M in the barrel tub 11. Accordingly, the vortex barrel polishing machine 10 has a stronger polishing force than the final finish rotary barrel polishing machine 40. Furthermore, since the rough finish medium Ma has a stronger polishing force than the other media Mf, Mg and Mh, the deburring and the rounding of the spacers S and the like are efficiently carried out by the large polishing force.

However, since the polishing force is large, fine powder produced from the spacers S and the rough finish media Ma by the polishing is likely to pierce into the surfaces of the spacers S and asperities formed on the surfaces of the spacers S with execution of the rough finish polishing process are the largest in the first to fifth polishing processes. Accordingly, the fine powder produced from the spacers S and the rough finish media Ma is likely to be caught by the asperities. In the rough finish polishing process, the cleaning liquid W is continuously supplied into the barrel tub 11 and waste liquid containing fine powder is continuously discharged. However, since the asperities on the surfaces of the spacers S are large, the fine powder which is caught by the asperities thereby to remain cannot sufficiently be removed only by the cleaning with the cleaning liquid W.

<First Semi-Finish Polishing Process>

In view of the above-described problem, the surfaces of the spacers S are polished by the first semi-finish media Mf in the first semi-finish polishing process after the rough finish polishing process. The semi-finish vortex barrel polishing machine 30 has a stronger polishing force than the final finish rotary barrel polishing machine 40, and the semi-finish medium Mf has a stronger polishing force than the other two media Mg and Mh used in post-processes. Accordingly, the polishing force in the first semi-finish polishing process is the second-largest after the rough finish polishing process in the first to fifth polishing processes. The asperities of the spacers S produced in the rough finish polishing process are rendered smaller by the larger polishing force with the result that the surfaces of the spacers S can efficiently be smoothed.

However, as the polishing force is large, an amount of fine powder produced from the spacers S is large. Furthermore, fine powder of silica that is a material of the abrasive grain G is produced from the first semi-finish media Mf. The fine powder of the spacers S and silica unavoidably pierce into the surfaces of the spacers S or are caught by the asperities. In the first semi-finish polishing process, too, the cleaning liquid W is continuously supplied into the barrel tub 31 and waste liquid containing fine powder is continuously discharged. However, the fine powder which has pierced into the surfaces of the spacers S cannot completely be removed only by the cleaning with the cleaning liquid W.

<Second Semi-Finish Polishing Process>

In view of the above-described problem, the surfaces of the spacers S are polished by the second semi-finish medium Mg in the second semi-finish polishing process after the first semi-finish polishing process. The semi-finish vortex barrel polishing machine 30 has a stronger polishing force than the final finish rotary barrel polishing machine 40. Furthermore, the second semi-finish medium Mg has a stronger polishing force than the final finish medium Mh used in post-processes. Accordingly, the polishing force in the second semi-finish polishing process is the third-largest in the first to fifth polishing processes. The asperities of the spacers S rendered smaller in the first semi-finish polishing process are rendered further smaller by the larger polishing force with the result that the surfaces of the spacers S can be further smoothed.

In the second semi-finish polishing process too, as long as the polishing is carried out, fine powder is produced from the spacers S and fine powder of silica that is a material of the second semi-finish medium Mg is produced. Although the asperities on the surfaces of the spacers S are rendered smaller than in the first semi-finish polishing process, the fine powder of the spacers S and silica unavoidably pierce into the surfaces of the spacers S or are caught by the asperities. In the second semi-finish polishing process, too, the cleaning liquid W is continuously supplied into the barrel tub 31 and waste liquid containing fine powder is continuously discharged as in the rough finish polishing process and the first semi-finish polishing process. However, the fine powder which has pierced into the surfaces of the spacers S cannot completely be removed only by the cleaning with the cleaning liquid W.

<Third Semi-Finish Polishing Process>

In view of the above-described problem, the surfaces of the spacers S are polished by the final finish medium Mh in the third semi-finish polishing process after the second semi-finish polishing process. The polishing force of the semi-finish vortex barrel polishing machine 30 is larger than the polishing force of the final finish rotary barrel polishing machine 40. Accordingly, the polishing force in the third semi-finish polishing process is the fourth-largest in the first to fifth polishing processes. The asperities of the spacers S rendered smaller in the second semi-finish polishing process are rendered further smaller by the relatively smaller polishing force, with the result that the surfaces of the spacers S are further smoothed.

In the third semi-finish polishing process, too, as long as the polishing is carried out, fine powder is produced from the spacers S though an amount of fine powder produced is small. Although the asperities on the surfaces of the spacers S are rendered further smaller than the second semi-finish polishing process, a small amount of fine powder of the spacers S cannot completely be avoided from piercing into the surfaces of the spacers S or from being caught by the asperities thereby to remain. In the third semi-finish polishing process, too, the cleaning liquid W is continuously supplied into the barrel tub 31 and waste liquid containing fine powder is continuously discharged as in the rough finish polishing process and the first and second semi-finish polishing processes. The fine powder which has pierced into the surfaces of the spacers S cannot completely be removed only by the cleaning with the cleaning liquid W.

<Final Finish Polishing Process>

In view of the above-described problem, the surfaces of the spacers S are polished by the final finish media Mh in the final finish polishing process after the third semi-finish polishing process. The final finish rotary barrel polishing machine 40 has a smaller polishing force than the semi-finish vortex barrel polishing machine 30, and the final finish medium Mh used in the final finish polishing process contains no abrasive grain G. Accordingly, the polishing force of the final finish processing process is the smallest in the five polishing processes. By the small polishing force, an extremely small amount of asperity remaining after execution of the third semi-finish polishing process is smoothed almost completely with the result that the surfaces of the spacers S are smoothed to reach a target surface roughness (for example, Ra 0.024 μm).

An amount of fine powder produced from the spacers S is extremely small since the polishing force of the final finish polishing process is the smallest in the first to fifth polishing processes. Moreover, in the final finish rotary barrel polishing machine 40 which causes the mass M to flow like an avalanche, the pressing force the final finish media Mh applied to the spacers S is smaller than in the vortex barrel polishing machines 10 and 30. Accordingly, fine powder does not pierce into the surfaces of the spacers S. Furthermore, in the final finish polishing process, too, the cleaning liquid W is continuously supplied into the barrel tub 41 and waste liquid containing fine powder is continuously discharged as in the rough finish polishing process and the first to third semi-finish polishing processes, and accordingly, there is no possibility that the fine powder remains on the surfaces of the spacers S. After the final polishing process, the spacers S are immersed in the cleaning liquid W of the ultrasonic cleaning machine 60 to be ultrasonically cleaned in the same manner as in the first embodiment.

<Comparison with Different Polishing Processes>

In the second embodiment, five polishing processes are carried out with the result that the surface roughness of the spacer S can finally be reduced to Ra 0.024 μm. TABLE 2 shows three, that is, fourth, fifth and sixth polishing experiments conducted as comparative examples with respect to the second embodiment.

In the fourth polishing experiment, polishing processes corresponding to the second and third semi-finish polishing processes and the final finish polishing process in the second embodiment were eliminated, and two polishing processes including the rough finish polishing process and the first semi-finish polishing process were carried out under the same conditions as those in the second embodiment. The surface roughness of the spacer S obtained by the fourth polishing experiment is Ra 0.049 μm, whereas the surface roughness of the spacer S obtained by the second embodiment is Ra 0.024 μm. This result shows that the surface of the spacer S has a higher surface smoothness in the polishing method of the second embodiment.

Furthermore, in the fifth polishing experiment, polishing processes corresponding to the third semi-finish polishing process and the final finish polishing process were eliminated, and three polishing processes from the rough finish polishing process to the second semi-finish polishing process were carried out under the same conditions as those in the second embodiment. The surface roughness of the spacer S obtained by the fifth polishing experiment is Ra 0.038 μm, whereas the surface roughness of the spacer S obtained by the second embodiment is Ra 0.024 μm. This result shows that the surface of the spacer S has a higher smoothness in the polishing method of the second embodiment. However, the surface cleanness and roughness obtained by the fifth polishing experiment are sufficiently satisfiable.

Furthermore, in the sixth polishing experiment, a polishing process corresponding to the final finish polishing process in the second embodiment was eliminated, and four polishing processes from the rough finish polishing process to the third semi-finish polishing process were carried out under the same conditions as those in the second embodiment. The surface roughness of the spacer S obtained by the sixth polishing experiment is Ra 0.034 μm. This result shows that the surface of the spacer S has a higher surface smoothness in the polishing method of the second embodiment. However, the surface cleanness and roughness obtained by the fifth polishing experiment are sufficiently satisfiable.

| | | Polishing process 1 |
|---|---|---|
| Pre-polishing | | |
| Fourth polishing experiment | Barrel polishing machine | Rough finish vortex barrel polishing machine |
| | Medium | Ma |
| | Polishing time | 8 hrs. |
| | Cleaning liquid | Continuous supply/discharge |
| Fifth polishing experiment | Barrel polishing machine | Rough finish vortex barrel polishing machine |
| | Medium | Ma |
| | Polishing time | 8 hrs. |
| | Cleaning liquid | Continuous supply/discharge |
| Sixth polishing experiment | Barrel polishing machine | Rough finish vortex barrel polishing machine |
| | Medium | Ma |
| | Polishing time | 8 hrs. |
| | Cleaning liquid | Continuous supply/discharge |
| Second Embodiment | Barrel polishing machine | Rough finish vortex barrel polishing machine |
| | Medium | Ma |
| | Polishing time | 8 hrs. |
| | Cleaning liquid | Continuous supply/discharge |

| | | Polishing process | | |
|---|---|---|---|---|
| | | 2 | 3 | 4 |
| Pre-polishing | | | | |
| Fourth polishing experiment | Barrel polishing machine | Semi-finish vortex barrel polishing machine | | |
| | Medium | Mf | | |
| | Polishing time | 3 hrs. | | |
| | Cleaning liquid | Continuous supply/discharge | | |
| Fifth polishing experiment | Barrel polishing machine | Semi-finish vortex barrel polishing machine | | |
| | Medium | Mf | Mg | |
| | Polishing time | 3 hrs. | 1 hr. | |
| | Cleaning liquid | Continuous supply/discharge | | |
| Sixth polishing experiment | Barrel polishing machine | Semi-finish vortex barrel polishing machine | | |
| | Medium | Mf | Mg | Mh |
| | Polishing time | 3 hrs. | 1 hr. | 1 hr. |
| | Cleaning liquid | Continuous supply/discharge | | |
| Second embodiment | Barrel polishing machine | Semi-finish vortex barrel polishing machine | | |
| | Medium | Mf | Mg | Mh |
| | Polishing time | 3 hrs. | 1 hr. | 1 hr. |
| | Cleaning liquid | Continuous supply/discharge | | |

-continued

| | | Polishing process 5 |
|---|---|---|
| Pre-polishing | | |
| Fourth polishing experiment | Barrel polishing machine | |
| | Medium | |
| | Polishing time | |
| | Cleaning liquid | |
| Fifth polishing experiment | Barrel polishing machine | |
| | Medium | |
| | Polishing time | |
| | Cleaning liquid | |
| Sixth polishing experiment | Barrel polishing machine | |
| | Medium | |
| | Polishing time | |
| | Cleaning liquid | |
| Second embodiment | Barrel polishing machine | Final finish rotary barrel polishing machine |
| | Medium | Mh |
| | Polishing time | 8 hrs. |
| | Cleaning liquid | Continuous supply/discharge |

| | Foreign matter removal Evaluation | Surface Roughness (Ra) |
|---|---|---|
| pre-polishing | | 0.050 μm |
| Fourth polishing experiment | X | 0.049 μm |
| Fifth polishing experiment | ○ | 0.038 μm |
| Sixth polishing experiment | ○ | 0.034 μm |
| Second embodiment | ◎ | 0.024 μm |

<Operation and Advantageous Effects>

In the surface treatment method of the second embodiment, the cleaning liquid W is supplied into and discharged from the barrel tub 11, 31 or 41 while the mass M including the spacers S and the media Ma, Mf, Mg or Mh is caused to flow in the barrel tub 11, 31 or 41, so that the polishing process for polishing the surfaces of the spacers S is carried out five times (at least once). The final finish medium Mh used in the third semi-finish polishing process and the final finish polishing process of the first to fifth polishing processes consists of the base material free from abrasive grain G and alumina.

According to this surface treatment method, since the final finish medium Mh used in the third semi-finish polishing process and the final finish polishing process contains no abrasive grain G, the spacer S can be finished with the smaller surface roughness. Furthermore, in the final finish polishing process, the spacers S and the final finishing media Mh are less likely to produce fine powder. Even if fine powder is produced, the powder is less likely to adhere to the surfaces of the spacers S since the surface roughness of the spacers S is rendered smaller in the final finish polishing. Therefore, fine powder is reliably removed from the surfaces of the spacers S by the cleaning force of the cleaning liquid W. According to the surface treatment method of the second embodiment, alumina can reliably be prevented from remaining on the surfaces of the spacers S with the result that alumina-free surface treatment can be realized.

Next, operation and advantageous effects specific to the second embodiment will be described. Since the final finish medium Mh comprises synthetic resin (unsaturated polyester) and does not contain any alumina, no alumina remains on the surfaces of the spacers S after the final finish polishing process.

Furthermore, the semi-finish polishing processes are carried out prior to the final finish polishing process. The semi-finish media Mf and Mg each of which abrasive grain G is bound by the binding material B are used in the semi-finish polishing processes. The binding material B of each of the semi-finish media Mf and Mg comprises synthetic resin (unsaturated polyester), and the abrasive grain G is silica and does not accordingly contain any alumina. As a result, no alumina remains on the surfaces of the spacers S.

Furthermore, a material of the abrasive grain G of the semi-finish media Mf and Mg includes silicon carbide, diamond, cubic boron nitride, zircon, zirconia, silica, boron carbide, iron oxide and chromium oxide. Of these materials, the abrasive grain G of the semi-finish media Mf and Mg is made from silica and does not contain any alumina. As a result, no alumina remains on the surfaces of the spacers S after the semi-finish polishing processes.

Furthermore, the binding material B of each of the semi-finish media Mf and Mg is unsaturated polyester, and the semi-finish media Mf and Mg contain abrasive grain G whose content rates are not more than 30 wt % and 10 wt % respectively. Unsaturated polyester used as the binding material B has advantages of cost effectiveness and easiness in forming. Furthermore, since the semi-finish media Mf and Mg contain abrasive grain G whose content rates are not more than 30 wt % and 10 wt % respectively, the flatness of the surfaces of the spacers S is improved after the semi-finish polishing process.

Furthermore, one first rough finish polishing process and the three semi-finish polishing processes are sequentially carried out prior to the final finish polishing process. The content rates of the abrasive grain G in the media Ma, Mf and Mg used in the respective processes are sequentially rendered lower in the processes. According to this configuration, the flatness of the surfaces of the spacers S can efficiently be improved.

Other Embodiments

The present invention should not be limited to the first and second embodiments described with reference to the drawings. For example, the technical scope of the invention encompasses the following embodiments.

(1) Although the cleaning liquid W is continuously supplied and discharged in each polishing process in the first and second embodiments, the supply and discharge of the cleaning liquid W may be carried out only in a second half or in a final phase of each polishing process or may be carried out intermittently at a plurality of times during each polishing process.

(2) Although the rotary type barrel tub 41 used in the final finish polishing process is rotatably supported by the paired horizontal hollow support shafts 43 in the first and second embodiments, the barrel tub used in the final finish polishing process may be of a vortex type that the rotary disk is rotated along the lower edge of the fixed tub.

(3) In the barrel tub 31 used in the semi-finish polishing processes, the rotary disk 34 is rotated in sliding contact with the fixed tub 33 in the first and second embodiments. However, in the barrel tub used in the semi-finish polishing processes, the rotary disk may be rotated out of contact with the fixed tub.

(4) In the first and second embodiments, the barrel tub used in the semi-finish processes is a vortex type barrel tub 31 in which the rotary disk disposed so as to close the lower end opening of the fixed tub 33 is rotated. However, the barrel tub used in the semi-finish processes may be a rotary type barrel tub rotatably supported by a pair of substantially horizontal hollow support shafts.

(5) Although the semi-finish polishing process is carried out three times in the first and second embodiments, the number of times of execution of the semi-finish polishing process may be not more than two times or not less than four times.

(6) Although each of the semi-finish media Mb, Mc and Md does not contain any abrasive grain having a higher hardness than silica in the first embodiment, each of the semi-finish media Mb, Mc and Md may contain abrasive grain having a higher hardness than silica.

(7) In the barrel tub 11 used in the rough finish polishing process, the rotary disk 14 is rotated not contacting the fixed tub 13 in the first and second embodiments. However, in the barrel tub used in the rough finish polishing process, the rotary disk may be rotated in sliding contact with the fixed tub.

(8) The specific weights of the media Mb, Mc and Md are sequentially rendered smaller in the course of treatment from the first semi-finish polishing process to the third semi-finish polishing process in the first embodiment. However, the specific weights of the media Mb, Mc and Md may be constant in a whole course of treatment from the first semi-finish polishing process to the final semi-finish polishing process.

(9) Although the surfaces of the spacers S (metal parts) are cleaned by the ultrasonic cleaning after the final finish polishing process in the first and second embodiments, the surface treatment of the spacers S (metal parts) may be completed without execution of the ultrasonic cleaning.

(10) Although the polishing process is carried out at a plurality of times in the first and second embodiments, only the final finish polishing process may be carried out once.

(11) Although the final finish medium Md is a ceramic medium containing silica as a main component in the first embodiment, the final finish medium may be a plastic medium consisting of base material only of thermoplastic resin or thermoset resin containing no abrasive grain, or a plastic medium made by binding abrasive grain of not more than 10 wt % and a binding material of thermoplastic resin or thermoset resin together.

(12) In the rough finish vortex barrel polishing machine 10, an inner periphery of the lower end of the rough finish fixed tub 13 is opposed to an outer periphery of the upper end of rotary disk 14 in the first and second embodiments. However, the rough finish vortex barrel polishing machine may be configured so that the lower end surface of the fixed tub is opposed to the upper end surface of the rotary disk, or the like.

(13) In the first and second embodiments, the ultrasonic cleaning process may be carried out at a plurality of times with the cleaning liquid W being replaced with new cleaning liquid W in one ultrasonic cleaning device 60. Furthermore, a plurality of ultrasonic cleaning devices 60 may be prepared to carry out a plurality of cleaning processes including rough cleaning, intermediate cleaning and finish cleaning, and the like.

(14) Although the abrasive grain G of the semi-finish media Mf and Mg comprises silica and contains no alumina in the second embodiment, the material of the abrasive grain G of the semi-finish media Mf and Mg may be silicon carbide, diamond, cubic boron nitride, zirconia, boron carbide, iron oxide or chromium oxide.

(15) Although the material of the final finish medium Mh is the thermoset resin comprising unsaturated polyester in the second embodiment, the final finish medium Mh may be any thermoplastic resin other than unsaturated polyester.

(16) Although the abrasive grain G of the first semi-finish medium Mf has a grain diameter (median diameter) of 10 μm in the second embodiment, it is preferable that the abrasive grain G of the first semi-finish medium Mf has a grain diameter (median diameter) ranging from 1 to 10 μm and further preferable that the abrasive grain G of the first semi-finish medium Mf has a grain diameter (median diameter) ranging from 1 to 5 μm.

(17) Although the abrasive grain G of the second semi-finish medium Mg has a grain diameter (median diameter) of 1 μm in the second embodiment, it is preferable that the abrasive grain G of the second semi-finish medium Mg has a grain diameter (median diameter) ranging from 1 to 10 μm and further preferable that the abrasive grain G of the second semi-finish medium Mg has a grain diameter (median diameter) ranging from 1 to 5 μm.

(18) The rough finish medium Ma may be a spherical one having a diameter of 6 mm in the second embodiment. In the case of a plastic medium normally used in a wet type surface treatment, the plastic medium is made into a conical shape having a bottom with a diameter of not less than 10 mm and a height of not less than 10 mm for reasons in manufacture and for the reason that the costs are raised. However, when the rough finish medium Ma is rendered smaller into a conical shape having a bottom with a diameter of 6 mm and a height of 6 mm, the surface roughness of the spacer S can be rendered smaller.

(19) Although the final finish medium consists of the synthetic resin base material containing no abrasive grain in the second embodiment, the final finish medium may be made by binding abrasive grain having a content rate of not more than 10 wt % and synthetic resin binding material together and also be free from alumina. In this case, the abrasive grain may comprise any one of silicon carbide, diamond, cubic boron nitride, zircon, zirconia, silica, boron carbide, iron oxide and chromium oxide and also be free from alumina.

What is claimed is:

1. A surface treatment method for metal parts, comprising:

a polishing step of supplying and discharging a cleaning liquid into and from a barrel tub while mass including a metal part and a medium is caused to flow in the barrel tub, thereby polishing a surface of the metal part, the polishing step being carried out at least once, wherein the at least one polishing step includes a final finish polishing process in which a final finish medium which is free from abrasive grain or which consists of a synthetic resin base material and is free from abrasive grain or which is made by binding abrasive grain of not more than 10 wt % and a synthetic resin binding material together and is free from alumina is used as the medium.

2. The method according to claim 1, wherein the final finish medium contains silica as a main component and is free from abrasive grain having a higher hardness than silica.

3. The method according to claim 1, wherein:

a semi-finish polishing process is carried out prior to the final finish polishing process; and a semi-finish medium free from abrasive grain having a higher hardness than silica is used as the medium in the semi-finish polishing process.

4. The method according to claim 3, wherein:

a rough finish polishing process is carried out prior to the semi-finish polishing process; and a rough finish medium is used as the medium in the rough finish polishing process, the rough finish medium containing abrasive grain having a higher hardness than silica.

5. The method according to claim 3, wherein:

the semi-finish polishing process is carried out at a plurality of times; and the semi-finish medium has a specific weight which is sequentially rendered smaller in a course of treatment from the first semi-finish polishing process to the final semi-finish polishing process.

6. The method according to claim 2, wherein the final finish medium is formed into a spherical shape and has a diameter of not more than 3 mm.

7. The method according to claim 1, wherein:

a final finish barrel tub is used as the barrel tub in the final finish polishing process, the final finish barrel tub being rotatably supported by a pair of substantially horizontal hollow support shafts coaxially arranged, the final finish barrel tub causing the mass to flow therein like an avalanche; and the cleaning liquid is supplied through one of the support shafts into the final finish barrel tub and discharged through the other support shaft from the final finish barrel tub.

8. The method according to claim 7, wherein:

a semi-finish polishing process is carried out prior to the final finish polishing process; and a semi-finish barrel tub is used as the barrel tub in the semi-finish polishing process, the semi-finish barrel tub causing a vortex flow in the mass by rotating a semi-finish rotary disk disposed to close a lower end opening of a cylindrical semi-finish fixed tub.

9. The method according to claim 8, wherein in the semi-finish barrel tub, the semi-finish rotary disk is rotated in sliding contact with a lower edge of the fixed tub.

10. The method according to claim 8, wherein:

a rough finish polishing process is carried out prior to the semi-finish polishing process; and a rough finish barrel tub is used as the barrel tub in the rough finish polishing process, the rough finish barrel tub including a cylindrical rough finish fixed tub and a rough finish rotary disk disposed to close a lower end opening of the rough finish fixed tub and rotated in non-contact with the rough finish fixed tub.

11. The method according to claim 1, wherein:

a semi-finish polishing process is carried out prior to the final finish polishing process;

a semi-finish medium made by binding abrasive grain of not more than 30 wt % and a binding material together is used in the semi-finish polishing process; and the binding material of the semi-finish medium is a synthetic resin.

12. The method according to claim 1, wherein the abrasive grain of the final finish medium and/or an abrasive grain of a semi-finish medium used in a semi-finish polishing process comprises any one of silicon carbide, diamond, cubic boron nitride, zircon, zirconia, silica, boron carbide, iron oxide and chromium oxide and is free from alumina, the semi-finish polishing process being carried out prior to the final finish polishing process.

13. The method according to claim 1, wherein the binding material of the final finish medium and/or a binding material used in a semi-finish polishing process carried out prior to the final finish polishing process is unsaturated polyester.

14. The method according to claim 1, wherein the abrasive grain of the final finish medium and/or an abrasive grain of a semi-finish medium used in a semi-finish polishing process carried out prior to the final finish polishing process has a median diameter of not more than 10 μm.

15. The method according to claim 4, wherein in a process of sequentially proceeding with the rough finish polishing process and the semi-finish polishing process both carried out prior to the final finish polishing process, content rates of abrasive grain contained in the media used in the respective polishing processes are sequentially lowered.

16. The method according to claim 1, wherein surfaces of the metal parts are cleaned by ultrasonic cleaning after the final finish polishing process.

* * * * *